US010081912B2

(12) United States Patent
Gallagher et al.

(10) Patent No.: US 10,081,912 B2
(45) Date of Patent: Sep. 25, 2018

(54) ROTORLESS PRESSURE KNOTTER

(71) Applicant: GL&V Luxembourg S.à.r.l., Munsbach (LU)

(72) Inventors: Brian Gallagher, Qualicum Beach (CA); Daniel Brouillette, Quebec (CA)

(73) Assignee: GL&V USA Inc., Nashua, NH (US)

( * ) Notice: Subject to any disclaimer, the term of this patent is extended or adjusted under 35 U.S.C. 154(b) by 0 days.

(21) Appl. No.: 15/578,807

(22) PCT Filed: Jun. 3, 2016

(86) PCT No.: PCT/IB2016/053272

§ 371 (c)(1),
(2) Date: Dec. 1, 2017

(87) PCT Pub. No.: WO2016/193942

PCT Pub. Date: Dec. 8, 2016

(65) Prior Publication Data

US 2018/0112356 A1 Apr. 26, 2018

Related U.S. Application Data

(60) Provisional application No. 62/170,956, filed on Jun. 4, 2015.

(51) Int. Cl.
*D21D 5/02* (2006.01)

(52) U.S. Cl.
CPC ..... *D21D 5/023* (2013.01)

(58) Field of Classification Search
CPC ..... B01D 29/114; B01D 29/15; B01D 29/33; B01D 29/885; B01D 36/045; B07B 1/18; D21B 1/026; D21B 1/08; D21B 1/32; D21D 5/02; D21D 5/023; D21D 5/046; D21D 5/06; D21D 5/22; Y02W 30/646
See application file for complete search history.

(56) References Cited

U.S. PATENT DOCUMENTS 2,301,201 A 11/1942 Chaplin
4,067,800 A * 1/1978 Young ..... B07B 1/20 209/273

FOREIGN PATENT DOCUMENTS

EP 267327 A1 5/1988

* cited by examiner

*Primary Examiner* — Patrick J Orme
(74) *Attorney, Agent, or Firm* — James Earl Lowe, Jr.

(57) ABSTRACT

A device including a hollow body defining axially extending compartments therein for receiving a slurry of pulp fibers in a carrying flow. The device includes a stationary screen within the hollow body defining a slurry compartment on one side of the screen, and a screened compartment on the other side of the screen. The hollow body also includes a slurry inlet into the slurry compartment, an elutriation suction outlet in communication with the slurry inlet, and elutriation nozzles into the slurry compartment. The device also includes an elutriation pump outside of the hollow body, the elutriation suction outlet being in fluid communication the elutriation pump, and the elutriation pump being in fluid communication with the elutriation nozzles.

17 Claims, 3 Drawing Sheets

ROTORLESS PRESSURE KNOTTER

BACKGROUND

In the processing of pulp for bleachable grades, one of the first process steps following cooking is the removal of larger uncooked pieces of wood, commonly referred to as knots. The device used for this purpose is the deknotter, more commonly referred to simply as the "knotter". This conventional nomenclature will be used here.

The knotter uses a barrier, or screen cylinder, with perforations in the 8 to 12 mm diameter range being most common, although perforations as small as 6 mm or as large as 16 have been used. The most common size is 9.5 mm diameter. Pulp stock passes through this screen cylinder, while the larger pieces of uncooked wood chips cannot pass through. Flows on the inlet side of the screen cylinder carry the knots to one end of the screen cylinder, from which they are discharged as "rejects".

All modern knotters are vertically mounted, use cylindrical screen cylinders, and are inward flow (meaning the inlet pulp passes from the outside of the screen cylinder to the inside). One type of conventional knotter uses a rotating screen cylinder with a stationary set of hydrofoils on the accept side, while another uses a stationary screen cylinder with rotating hydrofoils on the accept side.

With both types of conventional knotters, feed pulp at about 5% outside diameter consistency is presented to the inlet connection tangential to the top chamber. There is a nozzle in this inlet connection to accelerate the flow, which then flows rotationally around the outside of the perforated screen cylinder.

Accepted pulp goes through the perforations in the screen cylinder toward the center of the machine. From there it passes either upward or downward and then outward through a tangential accept connection.

Pulp on the outside (inlet side) of the screen cylinder that has not yet passed to the accepts continues moving in a rotating flow around the outside of the screen cylinder and also traveling downward. As this flow moves downward, the energy in it dissipates and the movement slows. If this movement were to ever stop completely, the machine would plug.

To prevent this, in the conventional knotter design that uses a stationary screen cylinder with rotating hydrofoils on the accept side, at a point approximately ⅔ of the way down the screen cylinder, a jet of high velocity dilution (known as the "elutriation flow") is injected tangentially along the wall of the chamber. The energy in this flow (which is equal to the flow times the velocity head) reinvigorates the stock flow and avoids any chance that the flow could stop and plug.

The elutriation flow is a much greater volume than the rejects flow, and most of this flow must pass into the accepts. It carries most of the pulp stock with it, leaving the reject consistency very low relative to the inlet consistency. This makes the job of the secondary knotter (the device which takes the knot-laden flow from the primary knotter and extracts the knots, discharging them finally in a damp state to a bunker or other disposal step) relatively easy.

In this design of machine, there are two specially designed hydrofoils on the inside of the screen cylinder there are two specially designed hydrofoils, mounted on a rotor and driven by a motor connected by V-belts, that produce an outward pulsation through the screen cylinder. It is the intent of these hydrofoils that they push any knots away from the inlet side of the screen cylinder so that the passing flow can carry them away.

Although the elutriation flow is fundamental to the operation of this design of conventional machine, this same flow also significantly dilutes the accept flow. Any dilution added to the pulp stream must be removed in the subsequent washing step in many instances, and the increased flow means that the equipment in that washing step must be larger, sometimes significantly so.

The solution used in the other type of conventional knotter is very similar, except to get around the need for the elutriation flow, the screen cylinder is mechanically driven and rotates. This has essentially the same effect as the elutriation does in the knotter that uses a stationary screen cylinder (minus the knot washing effect), but without the downside of diluting the pulp. These machines have stationary foils inside the rotating screen cylinder, which are fully analogous to the rotating foils of the conventional knotter with the stationary screen cylinder.

SUMMARY

Disclosed is a device including a hollow body defining axially extending compartments therein for receiving a slurry of pulp fibers in a carrying flow. The device includes a stationary screen within the hollow body defining a slurry compartment on one side of the screen, and a screened compartment on the other side of the screen. The hollow body also includes a slurry inlet into the slurry compartment, an elutriation suction outlet in communication with the slurry inlet, and elutriation nozzles into the slurry compartment. The device also includes an elutriation pump outside of the hollow body, the elutriation suction outlet being in fluid communication the elutriation pump, and the elutriation pump being being in fluid communication with the elutriation nozzles.

DRAWINGS

Figure 1:
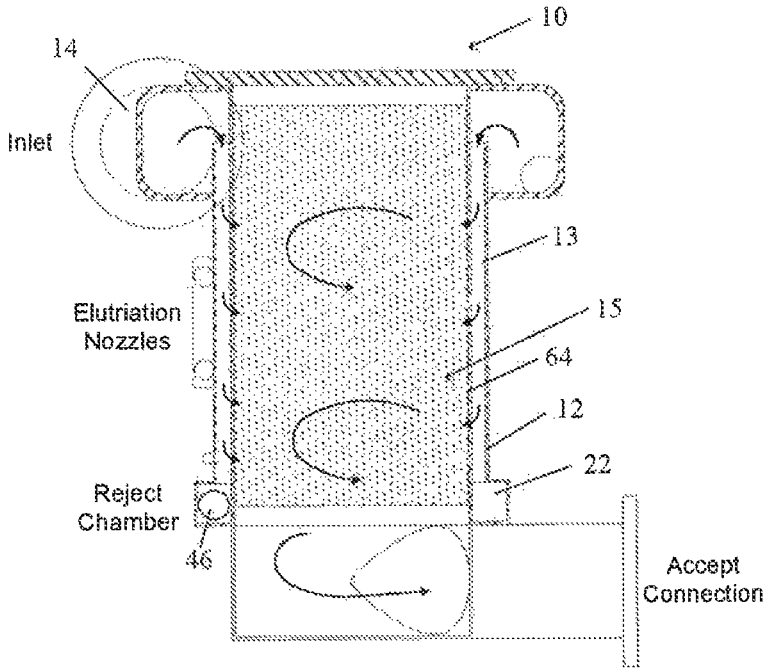
FIG. 1 is schematic cross sectional view of a device according to this disclosure.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DESCRIPTION OF THE PREFERRED EMBODIMENTS

Illustrated in the drawings is a device 10 including a hollow body 12 defining axially extending compartments therein for receiving a slurry of pulp fibers in a carrying flow. The device 10 also includes a stationary screen 64 within the hollow body 12 defining a slurry compartment 13 on one side of the screen 64, and a screened compartment 15 on the other side of the screen 64. The hollow body 12 also includes a slurry inlet 14 into the slurry compartment 13, introducing slurry circumferentially into the hollow body, an elutriation suction outlet 74 in communication with the slurry inlet 14, an elutriation pump 30 outside of and attached to the hollow body 12 via first and second pipes 17 and 19, respectively, and elutriation nozzles 18 into the slurry compartment 13. The device 10 also includes the first pipe 17 connecting the elutriation suction outlet 74 to the elutriation pump 30 so that there is fluid communication between them, and the second pipe 19 connecting the elutriation pump 30 to one or more elutriation nozzles 18 so that there is fluid communication between them. In other embodiments (not shown), manifolds or some other form of internal passageways could be used in lieu of the first and second pipes.

In one embodiment, the hollow body 12 also includes a rejects outlet 46 from a rejects chamber 22 spaced apart from the slurry inlet 14 and in communication with the slurry compartment 13. The elutriation nozzles 18 are positioned between the slurry inlet 14 and the rejects outlet 46 and the elutriation suction outlet 74 is positioned near but spaced apart from the slurry inlet 14. In one embodiment, the slurry inlet 14 is near an end of the hollow body 12, and the elutriation suction outlet 74 is also near the end of the hollow body 12, but spaced apart from the slurry inlet 14. An accepts outlet 26 is in communication with the screened compartment 15, and a junk trap 34 is in communication with the first pipe 17.

Without rotating components, the only mechanism available to keep a screen cylinder clear is the energy in the flows themselves. The relative velocities are very high; the velocity of the elutriation flow is normally as much as 22 m/s.

If the velocity of stock up to 5 or even 6% consistency past a perforation is sufficiently high, the perforation will remain unblocked and will pass flow. One visual aid of this is to consider the situation of a pipe with stock passing through it, even at normal pipeline velocities (2-4 m/s). If one were to drill a 10 mm hole in the side of that pipe, stock would spray from that hole continuously—it wouldn't block up because the formation of any flock large enough to block the hole would also be sufficiently large that the flow down the pipeline would draw it past, allowing flow out the hole to resume. The holes must be relatively large, and the velocity outward through the hole must be relatively small compared to the velocity down the pipe.

Extrapolate this to a pipe that is covered in holes. Flow would pass outward from all the holes until the axial velocity through the pipe became sufficiently low that the holes were not kept clear. In other words, at the beginning of the perforated area there would be flow, but at some point down the length of the pipe it would cease, because the loss of flow would make the pipeline velocity go down.

Now, instead of passing the flow down the middle of a pipe, make it go from the outside to the inside, and make the basic flow direction circumferential instead of axial. In other words, simulate the same flow path that exists in the conventional knotters. Since the flow is circumferential, any loss of flow to the accept chamber does not necessarily slow down the flow remaining on the inlet side.

The existing elutriation flow knotters maintain the high tangential velocity on the inlet side, but there is no reason that pulp stock could not be injected to produce the same effect.

It would be difficult to use stock from the feed pump for this purpose, because to be effective it must be at a high pressure relative to the inlet pressure, and it would be wasteful of energy to boost the entire inlet flow to that sort of pressure. It would be practical, however, to extract a small stream from the inlet, boost its pressure with a relatively small booster pump mounted immediately beside (or even attached to) the machine.

It would also appear to be advantageous to extract the flow for this purpose tangentially from the inlet chamber. The current machine has a junk trap tangentially on the inlet chamber, but its effectiveness is limited due to the consistency at which the machine operates and the relative forces that can be applied given the geometry of the inlet chamber. By extracting our "elutriation" flow from this chamber we will make it far more likely that tramp material will come with this flow. We can now direct the flow down toward a junk trap, then turn rapidly away toward the suction of the booster pump. This should greatly increase the chances of the tramp material actually dropping into the trap instead of being carried through the machine on the passing flow.

The stock from the junk trap would go directly into the suction of the booster pump. The discharge of the booster pump would go directly to the elutriation nozzle(s), and the pressure drop across these nozzles would be converted into velocity directed tangentially around the screening chamber. Although the current elutriation flow knotter use one or more nozzles, it is advantageous to use three or even more to distribute the introduction of energy to more of the screening chamber. The size of the machine will dictate the total area of the nozzles, which will in turn limit the number of possible nozzles on a smaller machine, since it is clear that a large nozzle will not plug but a small one would. Therefore, a small machine would likely only have one nozzle, but a very large one might have several.

It will still be possible, right at the bottom of the screen cylinder, to inject a similar elutriation flow 82 (see FIG. 5) comprised of filtrate, with the sole purpose of reducing the rejects consistency. With careful design, a flow equal to only the reject flow should be able to reduce the rejects consistency by half or more.

A particularly compelling advantage of the present disclosure is that there are no moving parts inside the machine 10 of FIGS. 1 to 4. The only moving part is the rotating element of the booster pump 30, which is expected to be a commercial, readily available pump. The booster pump 30 will be mounted beside the hollow body 12, making any maintenance extremely simple.

Figure 2:
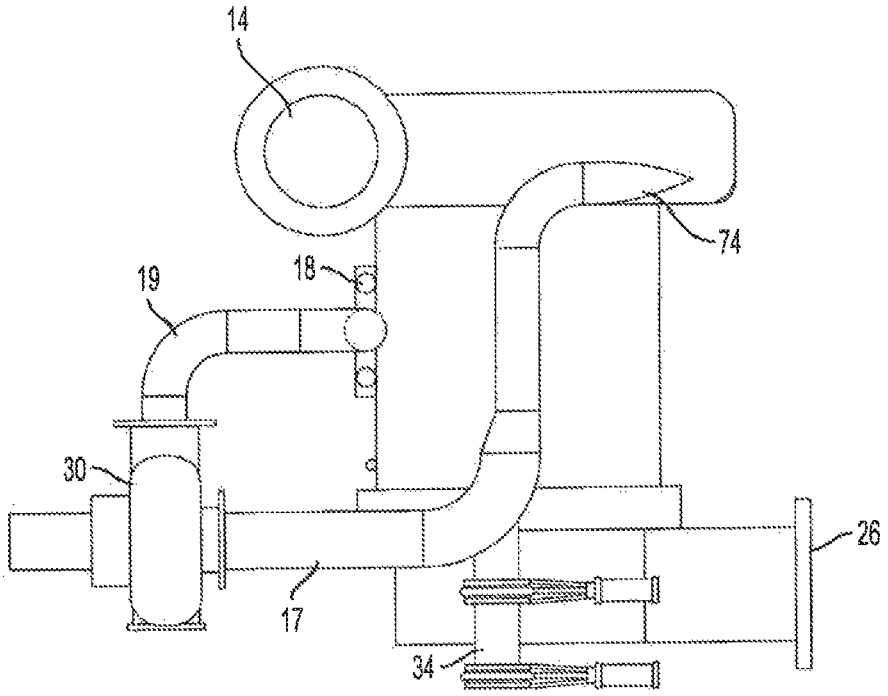
FIG. 2 is a side view of the device in FIG. 1.

In FIG. 2, the suction of the elutriation pump 30 is in fluid communication with the inlet chamber via the elutriation suction outlet 74 positioned near but spaced apart from the slurry inlet 14 near an end of the hollow body 12.

Figure 3:
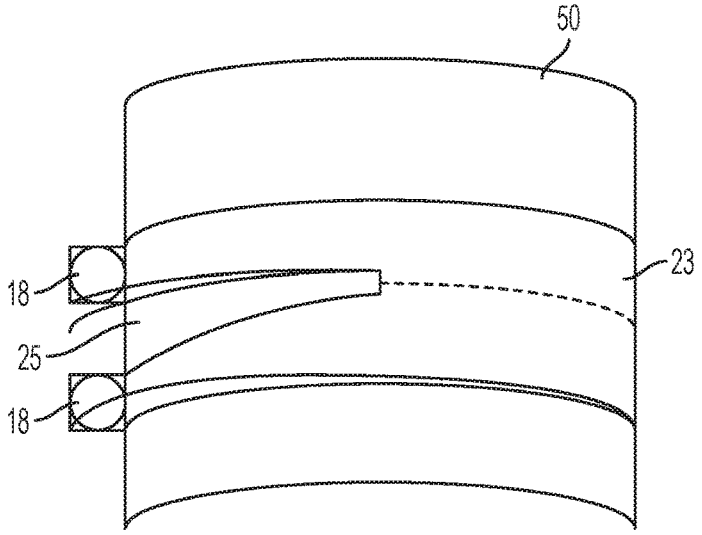
FIG. 3 is a cutaway of an elutriation entry area, in a case where there are two elutriation inlets, where a portion of the slurry inlet is split and then injected into the device.
Figure 4:
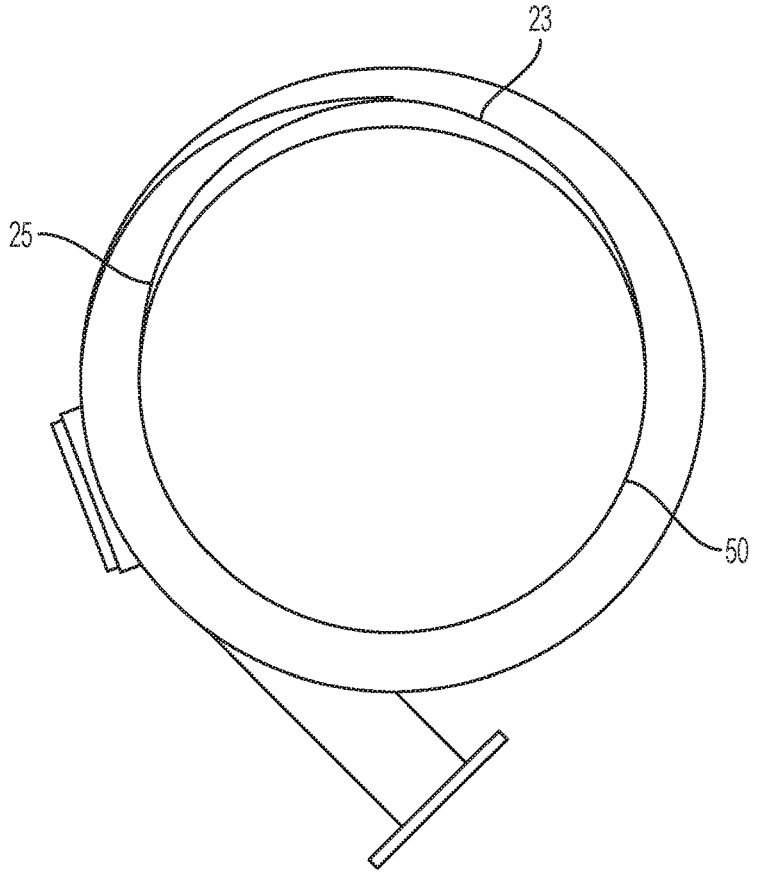
FIG. 4 is a cross section of the elutriation entry area shown in FIG. 3.

FIGS. 3 and 4 show one potential shape for the elutriation entry area. Two elutriation nozzles 18 are used. The flow is directed into a pair of channels 23 and 25 that converge into one at 90° of circumference. The combined channel decreases in depth until it ends flush with the outer wall 50 of the screening chamber at 180° from the nozzles.

Figure 5:
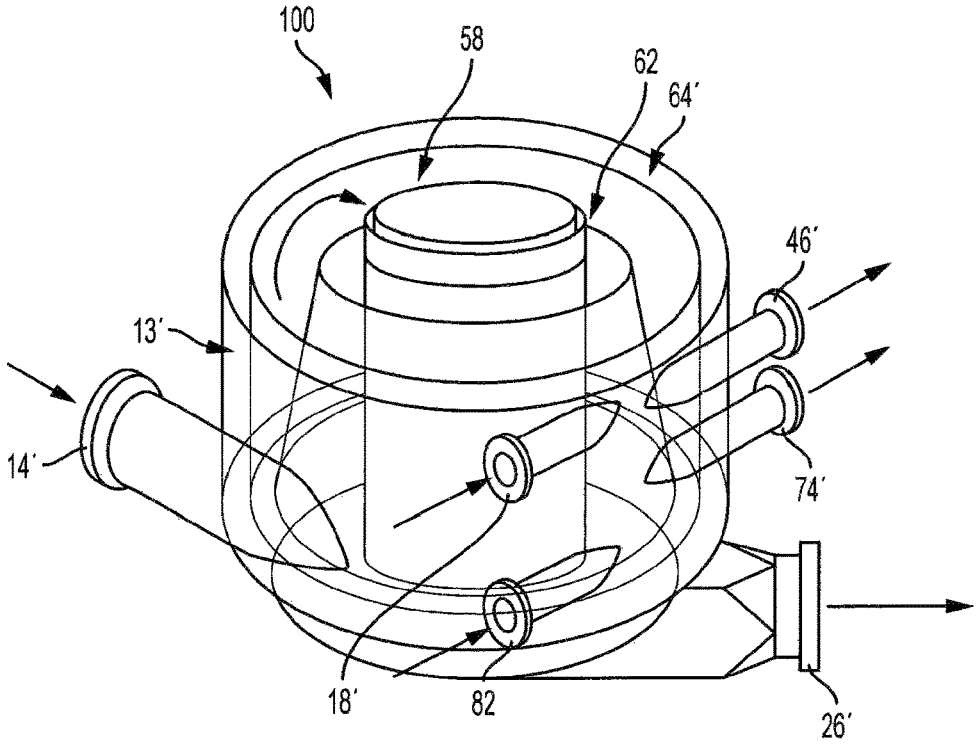
FIG. 5 is a schematic side perspective view of another device for filtering pulp according to this disclosure.
Figure 6:
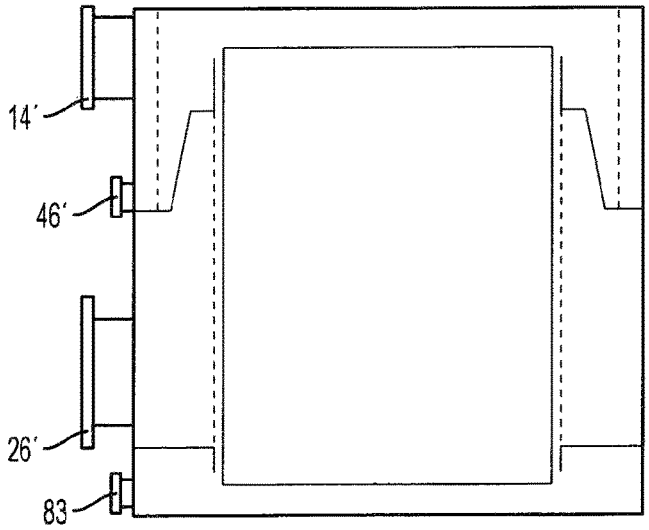
FIG. 6 is a schematic side cross sectional view of the device shown in FIG. 5.

In an alternate embodiment, a combination screen device 100 with both a deknotting screen and a fine screen is illustrated in FIGS. 5 and 6. Like elements to the device 10 have like numbers, only with an apostrophe. The device 100 is similar in some respects to and an improvement over the device shown in U.S. Pat. No. 8,011,515 issued 6 Sep. 2011, which is incorporated herein in its entirety.

The combination screen device 100 is now described from the inside out (in the reverse direction from the flow). In the center is a conventional pressure screen. It is outward flow, with a cylindrical screen cylinder 62 and rotor 58. There is an accept chamber for the screen, which in this FIGS. 5 and 6 is shown as a conical shape. The final accepted pulp goes downward where the flow is collected and exits the machine. FIG. 6 shows the screen reject flow 83, but it would come out of yet another chamber below the accept discharge.

Wrapped around the outside of this conventional screen is a new rotorless knotter. The inlet is on the outside of a stationary knotter screen cylinder 64'. The elutriation flow is injected into this knotter inlet chamber, and the knotter accepts go radially inward into the tapered chamber formed by the outside of the screen accept chamber. This provides a ready path upwards then radially inward to the inlet of the conventional screen.

In the embodiment shown in FIGS. 5 and 6, the elutriation suction 74' is draw from the middle of the knot flow chamber. The knotter screen cylinder needs to be roughly 75% of the area of the fine screen cylinder 62, but since it is also larger in diameter, it becomes much shorter. Therefore, the actual geometry looks more like that shown in FIG. 6.

This is roughly to scale for a 750 mm 750 mm fine screen.

The invention claimed is:

1. A device for screening a slurry of pulp fibers in a carrying flow including an axially extending hollow body for receiving a slurry of pulp fibers in a carrying flow, an axially extending stationary screen within the hollow body defining an axially extending slurry compartment on one side of the screen, and an axially extending screened compartment on the other side of the screen, the hollow body also includes a slurry inlet into the slurry compartment, an elutriation suction outlet in communication with the slurry inlet, and an elutriation nozzle into the slurry compartment, and the device also includes an elutriation pump outside of the hollow body, a first pipe connecting the elutriation suction outlet to the elutriation pump, and a second pipe connecting the elutriation pump to the elutriation nozzle.

2. A device according to claim 1 wherein the hollow body includes a rejects outlet spaced apart from the slurry inlet and in communication with the slurry compartment, and the elutriation nozzle is positioned between the slurry inlet and the rejects outlet.

3. A device according to claim 1 wherein the elutriation suction outlet is positioned near but spaced apart from the slurry inlet.

4. A device according to claim 1 wherein the slurry inlet is near an end of the hollow body, and introduces slurry circumferentially into the hollow body, and wherein the elutriation suction outlet is near the end of the hollow body.

5. A device according to claim 1 wherein the elutriation suction outlet is in communication with the slurry compartment.

6. A device according to claim 1 wherein the elutriation pump is attached to the outside of the hollow body.

7. A device according to claim 4 wherein the hollow body is cylindrical, and where the first pipe is connected to the elutriation suction outlet, the first pipe extends tangentially from the hollow body in a direction of slurry flow inside the hollow body.

8. A device according to claim 7 wherein a junk trap is connected to the first pipe.

9. A device according to claim 8 wherein where the junk trap connects to the first pipe, the first pipe makes a sharp turn.

10. A device for screening a slurry of pulp fibers in a carrying flow including an axially extending hollow for receiving a slurry of pulp fibers in a carrying flow, an axially extending stationary screen within the hollow body defining an axially extending slurry compartment on one side of the screen, and an axially extending screened compartment on the other side of the screen, the hollow body also includes a slurry inlet into the slurry compartment, an elutriation suction outlet in communication with the slurry inlet, and an elutriation nozzle into the slurry compartment, and the device also includes an elutriation pump outside of the hollow body, the elutriation suction outlet being in fluid communication the elutriation pump, and the elutriation pump being in fluid communication with the elutriation nozzle.

11. A device according to claim 10 wherein a plurality of elutriation nozzles is in fluid communication with the elutriation pump.

12. A device according to claim 11 wherein the hollow body includes a rejects outlet spaced apart from the slurry inlet and in communication with the slurry compartment, and the elutriation nozzles are positioned between the slurry inlet and the rejects outlet.

13. A device according to claim 11 wherein the elutriation suction outlet is positioned near but spaced apart from the slurry inlet.

14. A device according to claim 11 wherein the slurry inlet is near an end of the hollow body, and introduces slurry circumferentially into the hollow body, and wherein the elutriation suction outlet is near the end of the hollow body.

15. A device according to claim 11 wherein the elutriation suction outlet is in communication with the slurry compartment.

16. A device according to claim 11 wherein the elutriation pump is attached to the outside of the hollow body.

17. A device according to claim 11 wherein the hollow body is cylindrical, and where a first pipe is connected to the elutriation suction outlet, the first pipe extends tangentially from the hollow body in a direction of slurry flow inside the hollow body.

* * * * *